US009487997B2

(12) United States Patent
Kovach et al.

(10) Patent No.: US 9,487,997 B2
(45) Date of Patent: Nov. 8, 2016

(54) STIFFENED PULL CORD FOR ARCHITECTURAL COVERINGS

(75) Inventors: Joseph E. Kovach, Brighton, CO (US); Paul G. Swiszcz, Niwot, CO (US)

(73) Assignee: Hunter Douglas Inc., Pearl River, NY (US)

( * ) Notice: Subject to any disclaimer, the term of this patent is extended or adjusted under 35 U.S.C. 154(b) by 235 days.

(21) Appl. No.: 13/985,881

(22) PCT Filed: Feb. 16, 2012

(86) PCT No.: PCT/US2012/025507

§ 371 (c)(1), (2), (4) Date: Aug. 16, 2013

(87) PCT Pub. No.: WO2012/112809

PCT Pub. Date: Aug. 23, 2012

(65) Prior Publication Data

US 2013/0319622 A1 Dec. 5, 2013

Related U.S. Application Data

(60) Provisional application No. 61/443,578, filed on Feb. 16, 2011, provisional application No. 61/443,575, filed on Feb. 16, 2011, provisional application No. 61/451,364, filed on Mar. 10, 2011, provisional application No. 61/451,372, filed on Mar. 10, 2011.

(51) Int. Cl.

| | |
|---|---|
| ***E06B 9/305*** | (2006.01) |
| ***E06B 9/386*** | (2006.01) |
| ***E06B 9/388*** | (2006.01) |
| ***E06B 9/326*** | (2006.01) |

(52) U.S. Cl.

CPC ..... *E06B 9/326* (2013.01)

(58) Field of Classification Search

CPC ..... E06B 9/326; E06B 9/78; E06B 2009/785
USPC ..... 160/168.1 R, 173 R; 280/480
See application file for complete search history.

(56) References Cited

U.S. PATENT DOCUMENTS

| | | | | |
|---|---|---|---|---|
| 2,372,142 | A | 3/1945 | Warren, Jr. | |
| 4,735,035 | A | 4/1988 | Mattioli | |
| 5,291,856 | A * | 3/1994 | Goller | 119/795 |
| 5,709,258 | A | 1/1998 | Coccoluto | |
| 5,722,478 | A * | 3/1998 | Claypool et al. | 160/173 R |
| 5,735,329 | A * | 4/1998 | Akins et al. | 160/178.1 R |
| 5,771,952 | A | 6/1998 | Gabriel | |
| 6,752,194 | B1 | 6/2004 | Huang | |
| 7,281,564 | B2 * | 10/2007 | Dekker | 160/178.1 R |
| 2006/0011310 | A1 * | 1/2006 | Chou | 160/178.1 R |
| 2008/0173414 | A1 * | 7/2008 | Cheng | 160/405 |
| 2011/0100569 | A1 | 5/2011 | Perkowitz | |

FOREIGN PATENT DOCUMENTS

| | | |
|---|---|---|
| GB | 996314 A | 6/1965 |

* cited by examiner

*Primary Examiner* — Katherine Mitchell
*Assistant Examiner* — Jeremy Ramsey
(74) *Attorney, Agent, or Firm* — Dorsey & Whitney LLP

(57) ABSTRACT

A control element for actuating an operating mechanism for a retractable shade. The retractable shade having a flexible operating cord retractable and extendable from the operating mechanism, the flexible operating cord having a free end. The control element is attached to the flexible operating cord and includes a core having a length, the core being stiffened along the length so as to resist becoming entangled and an upper end of the length that is attached to the free end of the flexible operating cord.

22 Claims, 5 Drawing Sheets

STIFFENED PULL CORD FOR ARCHITECTURAL COVERINGS

CROSS-REFERENCE TO RELATED APPLICATIONS

This application is the national stage application of PCT Patent Application No. PCT/US2012/025507, entitled "Stiffened Pull Cord For Architectural Coverings," filed on Feb. 16, 2012, which claims the benefit under 35 U.S.C. §119(e) to U.S. Provisional Patent Application No. 61/443,575 entitled "Rigid Pull Cord," filed on Feb. 16, 2011; U.S. Provisional Patent Application No. 61/443,578 entitled "Rigidified Pull Cord," filed on Feb. 16, 2011; U.S. Provisional Patent Application No. 61/451,372 entitled "Rigid Pull Cord," filed on Mar. 10, 2011; and U.S. Provisional Patent Application No. 61/451,364 entitled "Rigidified Pull Cord," filed on Mar. 10, 2011. These applications are hereby incorporated herein by reference in their entireties.

TECHNICAL FIELD

The present disclosure relates generally to coverings for architectural openings and more specifically, to pull cords for operating architectural coverings.

BACKGROUND

Retractable coverings for architectural openings can be operated in numerous ways known in the art, but common practice has been to utilize flexible control elements or pull cords which are suspended from one end of a headrail. A shade material for the covering is also suspended from the headrail with the pull cords being operatively connected to a control mechanism within the headrail for moving the shade material between extended and retracted positions across an architectural opening such as a window, door, archway or the like.

Conventional operating cords are very flexible so they can pass around pulleys, through brake systems, and the like, to facilitate a smooth, dependable, and reliable operation of the covering. Often multiple operating cords are joined together at associated ends with a connector to which a single, manually operable operating or pull cord is also joined. These flexible cords can become entangled with themselves thereby forming loops.

Wands have been used to control coverings for architectural openings, and typically are not used to replace the pull cords mentioned above but rather are pivotally connected to an operating mechanism at the headrail and used to open or close vanes or slats in the covering by twisting the wand about its longitudinal axis. The wands are not raised or lowered like pull cords and have fairly broad profiles since they must be strong enough to resist the torque applied thereto. An example of such a wand is conventionally found in Venetian blinds where the slats are tilted between open and closed positions by rotating such a wand but the blind itself is raised or lowered by alternatively pulling and raising flexible pull cords which are susceptible to becoming entangled with themselves as mentioned above.

The present disclosure has been developed as a way of alleviating entanglement of pull cords or operating cords with themselves so as to reduce or eliminate the risk of a loop being formed.

SUMMARY

Pursuant to the present disclosure, a pull cord is designed to be operatively connected to an operating mechanism for a covering for an architectural opening with the cord being at least partially rigid or stiffened so that it cannot be folded, or resists folding upon itself and yet can be used as a pull cord for alternatively pulling and raising the covering. Wands of the prior art have typically been used to tilt slats, vanes or the like by twisting or rotating the wand about its longitudinal axis. In other words, the stiffened cord of the present disclosure is a replacement, or addition to, the flexible pull cords commonly found in the art which previously have been susceptible to entanglement with themselves.

The stiffened pull cord pursuant to the present disclosure is operatively connected to one or a plurality of more flexible operating cords confined within the headrail for a covering with the flexible cords typically being fully confined within the headrail or possibly being temporarily extended for a short distance outside the headrail such as cords used in a unidirectional, ratchet-type drive system where the cords can be extended temporarily from the headrail but automatically retract into the headrail after the pull cord has been pulled downwardly in operating the covering. In this manner, substantially the only cord that may be exposed outside of the headrail or shade may be the stiffened pull cord of the present disclosure. Pursuant to the disclosure, the flexible operating cords conventionally used in coverings for architectural openings can be substantially confined to the headrail or in the shade material where they may be used to operate the covering but may be connected to a manually operable stiffened pull cord pursuant to the present disclosure, where the stiffened pull cord may substantially be prevented from becoming entangled with itself.

A stiffened pull cord pursuant to the present disclosure might be made of a core material that can be rendered rigid or partially rigid such as a glass-filled polymer, fiberglass composite, metal, wood, or other rigid or partially rigid materials. In some instances, the core material may be coated, plated, or overmolded with rubbering materials. The core may be a single material or a combination of two or more materials. For example, the core may be two materials operably connected together or an outer material surrounding an inner material, where the two materials may have different rigidity characteristics or may have the same rigidity characteristics. The core may also be encased within a sheath of a braid or webbed material of polyester or some other synthetic or natural fiber.

The sheath may give the rigid cord the appearance of a flexible cord as well as the tactile sensation of flexible cords conventionally found in coverings without substantially detracting from the rigidity of the core. Additionally, the sheath may provide some additional rigidity to the cord. The lower free end of the stiffened pull cord may include a tassel to facilitate gripping by the user of the cord as well as to obtain desired aesthetics. The top or opposite end of the stiffened pull cord might have a connector so that the cord can be easily connected or disconnected from one or more flexible operating cords extending through the headrail and possibly the shade material for the covering. This connector may act as a motion limiting member or "stop" and may also connect the flexible operating cords to the stiffened pull cord.

The rigid cord with or without the sheath can be used in lieu of pull cords found in conventional operating systems for coverings but finds an ideal use with an operating system using a unidirectional or ratchet-type drive where the pull cord is reciprocally pulled downwardly at a predetermined angle to either raise or lower the covering and then allowed to rise retracting all of the more flexible operating cords into the headrail where they are substantially confined and not exposed. The flexible operating cords be substantially unexposed as they may be automatically retracted into the headrail after every downward pulling stroke on the pull cord. When the stiffened pull cord of the disclosure is used with such a system, the stiffened pull cord may be longer than the downward pulling stroke permitted by the unidirectional drive system so that the stiffened pull cord may not be doubled about its attachment to the more flexible cords possibly becoming entangled therewith when they are extended out of the headrail during a downward pulling stroke of the pull cord.

Other aspects, features and details of the present disclosure can be more completely understood by reference to the following detailed description of a preferred embodiment, taken in conjunction with the drawings and from the appended claims.

DETAILED DESCRIPTION

A stiffened pull cord 102 or control element of the present disclosure may be primarily used in coverings 100 for architectural openings. The stiffened pull cord 102, as will be discussed in more detail below, may be generally less flexible than conventional operating cords for architectural coverings. In some instances, the stiffened pull cord 102 may be at least partially rigid or rigidified. The amount of rigidity may be varied depending on the desired degree of flexibility, the diameter of the pull cord, the length of the pull cord, and so on. Due to the stiffness or rigidity of the pull cord, the pull cord may be substantially prevented from becoming entangled with itself. It should be noted that the terms rigid and rigidified are meant to indicate different degrees of flexibility or lack thereof, in that a rigid component may be less flexible than a rigidified component. As the pull cord may have varying degrees of flexibility it is referred to herein as a "stiffened" or "stiff" pull cord, which is meant to encompass substantially all varying degrees of flexibility, such as resilient, inflexible, rigid and rigidified.

Figure 1:
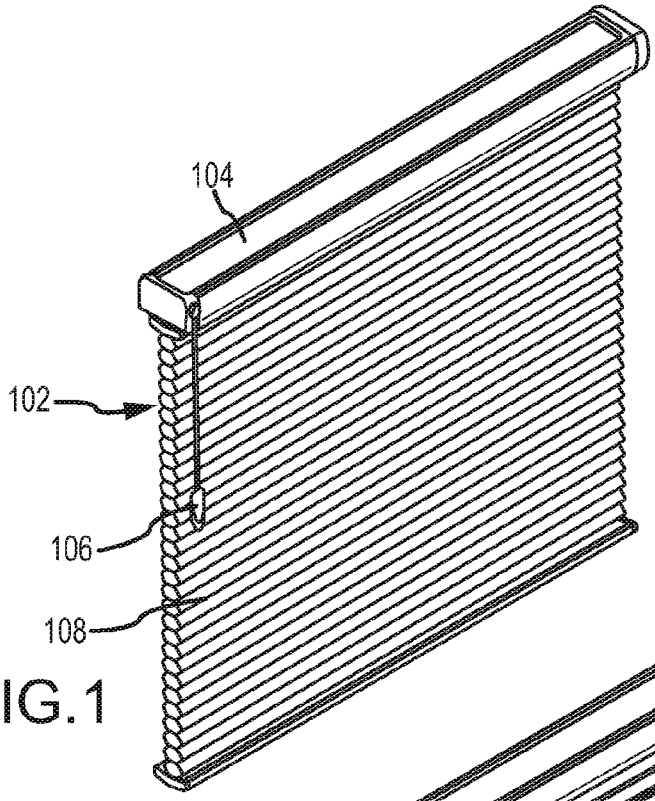
FIG. 1 is an isometric view of a retractable architectural covering incorporating a pull cord of the present disclosure with the covering shown in an extended position.
Figure 2A:
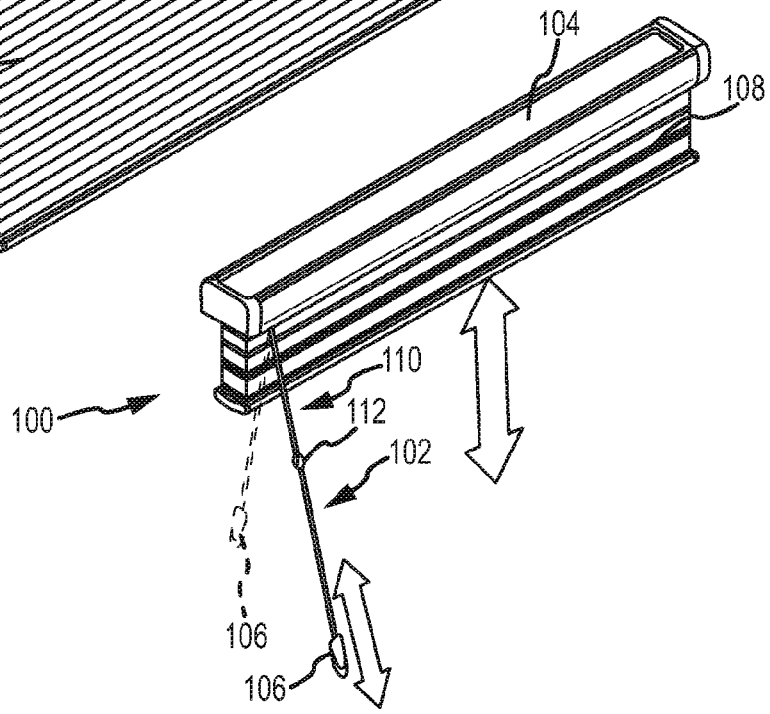
FIG. 2A is an isometric view of the retractable covering of FIG. 1 with the covering in a retracted position and with the pull cord being extended and retracted in an operating mode.

The covering 100 illustrated in FIGS. 1 and 2A may be retractable and the headrail 104 may include a control system (not shown) and a retractable shade material 108 suspended from the headrail 104 which is adapted to be moved between extended and retracted positions across the architectural opening in which it is mounted with the control system and, for example, a stiffened pull cord 102 pursuant to the present disclosure.

Operating systems for such retractable coverings vary in nature, but may change the position of the shade material 108 based on a force from the stiffened pull cord 102, e.g., from a user pulling on the stiffened pull cord 102. The stiffened pull cord 102 may be suspended from one or both ends of the headrail 104 and may be in operative relationship with the control system for the covering 100 and may therefore replace pull or operating cords depending from one or both end of the headrail as found in prior art systems. In other words, the covering 100 utilizing the pull cord 102 of the present disclosure may include the stiffened pull cord 102 pursuant to the disclosure at one or both ends of the headrail 104 dependent upon the operating system(s) with which it/they are operatively connected.

While the stiffened pull cord 102 could be used with many types of operating systems, in some embodiments the stiffened pull cord 102 may be used with an operating system using a unidirectional or ratchet-type drive where the stiffened pull cord 102 is reciprocally pulled downwardly as shown in FIG. 2A at a predetermined angle to either raise or lower the covering 100 and then allowed to rise, retracting all or a substantially portion of more flexible operating cords 110 back into the headrail 104. The more flexible operating cords 110, which may be a non-rigid material that may be draped or entangled around itself, may be prevented from being fully exposed as they may be automatically retracted into the headrail 104 after every downward pulling stroke on the cord 102. In other words, the stiffened pull cord 102 may be operably connected to one or more flexible operating cords 110, such that as the stiffened pull cord 102 is manipulated by a user, the force experienced by the stiffened pull cord 102 may be translated to the flexible operating cords 110 to operate the covering 100. However, after the covering 100 has been desirably manipulated, the flexible operating cords 110 may be at least partially retracted into the headrail 104, so that the only cord which may be exposed may be the stiffened pull cord 102.

The length of the pull cord 102 may be varied depending on the length of the covering; however, as shown in FIGS. 1 and 2A the stiffened pull cord 102 may be approximately between 4 inches to approximately 36 inches and in some instances may range between 12 inches to 20 inches in length. In these embodiments, the length may be selected so that there is sufficient area for a user to grasp the pull cord 102, and so that the pull cord 102 may not be too high from a support surface when the flexible operating cords 110 are retracted into the headrail 104 to prevent a user from grasping the cord 102. In other words, the pull cord 102 length may be selected so that the pull cord 102 may be exposed for manual manipulation typically at one or both ends of a headrail 104 for the covering.

Figure 2B:
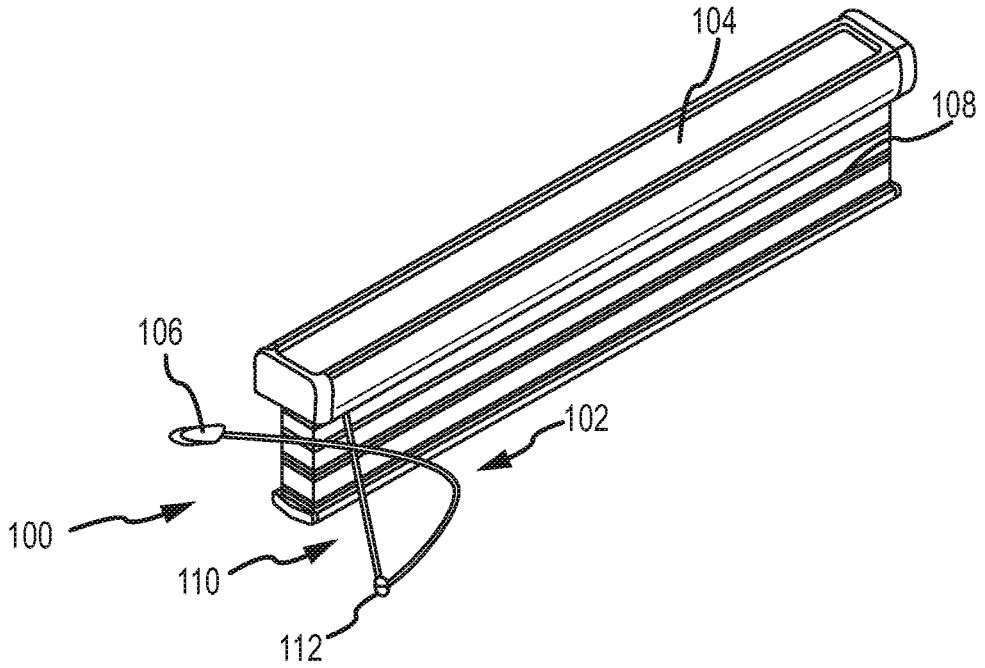
FIG. 2B is an isometric view of the retractable covering of FIG. 2A, with the pull cord partially bent, but substantially resisting entangling with itself.

FIG. 2B is an isometric view of the covering illustrating the stiffened pull cord 102 partially bent, but prevented from entangling with itself. In FIG. 2B, the flexible operating cords 110 are under tension to extend or retract the shade relative to the headrail 104. The stiffened pull cord 102 is oriented to extend upwardly from the connection member 112 between the stiffened pull cord 102 and the flexible operating cords 110. As a force is applied to the stiffened pull cord 102 to apply tension to the flexible operating cords 110, the stiffened pull cord 102 may bend along its length, but may not sufficiently bend to form a loop or other entanglement with itself or the flexible operating cords 110. The stiffened pull cord 102 is in this case sufficiently stiff to apply a sufficient force to actuate the flexible operating cords 110, and bend as shown. When the extension force is removed from the stiffened pull cord 102, it will return to its linear shape, or possibly retain somewhat of a curve, as described in more detail below.

In some instances, the length of the stiffened pull cord 102 may be selected to be longer than a length of the portion of the flexible operating cords 110 below the headrail 104 when extended to actuate the shade to its fullest extent. That is, when the shade is extended the flexible operating cords 110 are in a retracted position with the flexible operating cords 110 substantially not exposed from the headrail 104. When the shade is retracted, the flexible operating cords 110 are extended a particular distance out of the headrail 104, thus exposing a length of the flexible operating cords 110. The stiffened pull cord 102 may thus be longer than the length of the flexible operating cords 110 that are exposed when a user provides a downwards force to the pull cord 102. In these instances, since the stiffened pull cord 102 is longer than the flexible operating cords 110, the stiffness of the pull cord 102 may help to prevent the flexible operating cords 110 from entangling as well. With reference to FIG. 2B, this is because in some instances the flexible operating cords 110 may be under tension as they are connected to the control system (not shown), typically in the headrail 104, and/or due to a user force. As such, as the flexible operating cords 110 extend from the headrail 104 they may form a relatively straight line to the stiffened pull cord 102. Since the stiffened pull cord 102 is at least partially rigidified, it is substantially prevented from entangling with itself, e.g., forming a circle or knot. Accordingly, the stiffened pull cord 102 may be prevented or restricted from forming a circle, even when under force, that could entangle the pull cord 102 with itself and/or with the flexible operating cords 110.

The stiffened pull cord 102 itself may include a tassel 106 at a lower free end thereof to facilitate manual manipulation of the cord 102, as well as to obtain the desired aesthetics. The pull cord 102 may also be operably connected to a clip or other connecting member 112 at an upper or opposite end of the tassel 106 for connection to the more flexible operating cords 110 of the control system for the covering 100. In other instances, the connecting member 112 may be omitted and/or other connection means, such as adhesive, may be used to operably connect the stiffened pull cord 102 to the flexible operating cord or cords 110. The connection member 112 will be discussed in more detail below with respect to FIG. 4.

The stiffened pull cord 102 may extend from the headrail and may be low enough in order to be accessible by a user, but in some instances may not extend far enough or be long enough in order to reach the floor or other support surface beneath the architectural opening.

Figure 3:
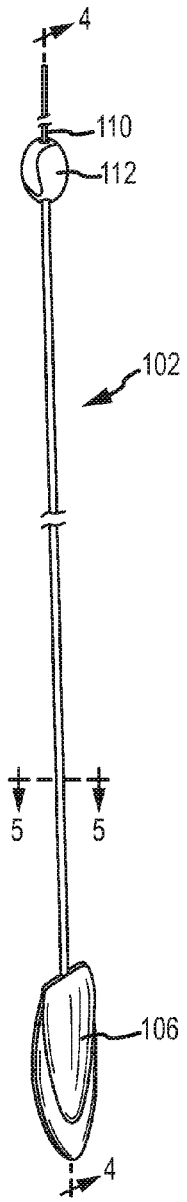
FIG. 3 is an isometric view of the pull cord of FIG. 1 operably connected to a tassel on a lower end and a connector operably connected to an upper end.
Figure 4:
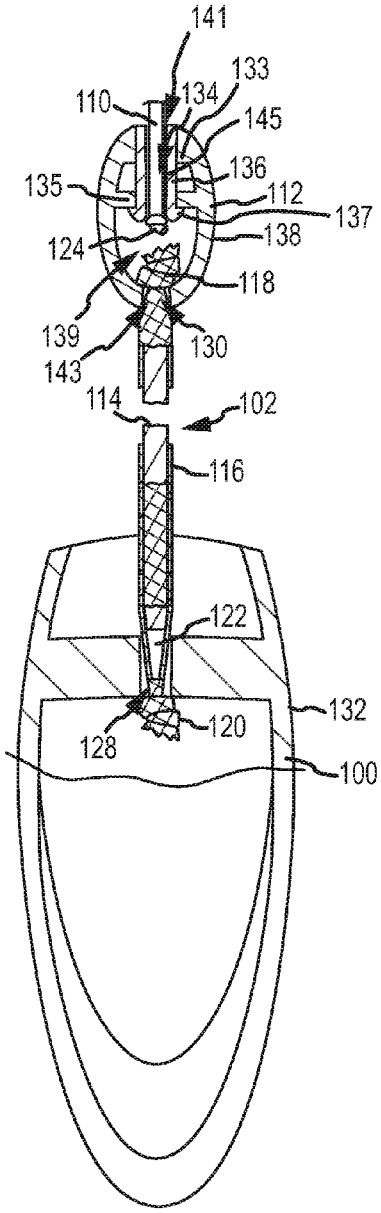
FIG. 4 is an enlarged fragmentary cross-section of the pull cord, tassel, and connector taken along line 4-4 in FIG. 3.
Figure 5:
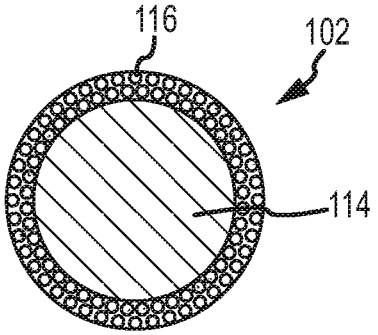
FIG. 5 is a transverse cross-section of the pull cord illustrating a core and an outer sheath taken along line 5-5 in FIG. 3.
Figure 7:
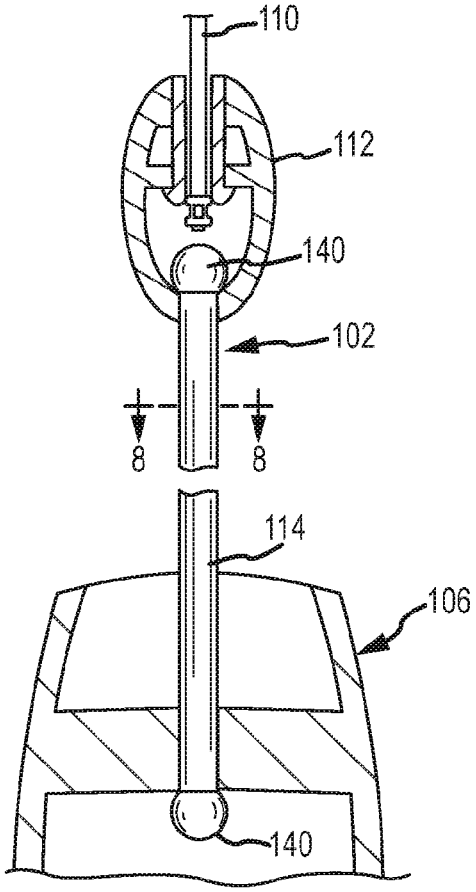
FIG. 7 is a cross-section of the pull cord, tassel, and connector similar to FIG. 6 illustrating another system for operably connecting the pull cord to the tassel and connector, and with a first example of a pull cord shown without an outer sheath.

The stiffened pull cord 102 will now be discussed in more detail. FIG. 3 is an isometric view of the stiffened pull cord 102 including the tassel 106 and the connecting member 112. FIG. 4 is a cross-section view of the stiffened pull cord 102, tassel 106, and connecting member 112. FIG. 5 is a cross-section view of the pull cord 102 taken along line 5-5 in FIG. 3. In some examples, the stiffened pull cord 102 may include an elongated core element 114 that may be at least partially encased within an elongated sheath 116. In other embodiments, the sheath 116 may be omitted and the stiffened pull cord 102 may include only the core 114. For example, FIG. 7 is a cross-section view of the pull cord 102, the tassel 106, and the connecting member 112 illustrating the sheath 116 removed from the core 114.

The core 114 may be a single material (as shown in FIG. 5), or may include two or more materials or components operably connected together. For example, the core 114 may include an inner material that may be substantially surrounded by an outer material or may include a first portion and second portion secured together along a surface. In these examples, the stiffness of the core 114 may be varied by varying the stiffness of one or both materials. Additionally, in some instances the core 114 may be formed of two halves, where each half may have a separate stiffness, such that the core 114 may be more easily bent in one direction. When the core 114 includes two or more materials operably connected together, the two materials may be secured by adhesive, may be sonically welded together, or may be secured in other manners such as fasteners or the like.

As will be discussed in more detail below, the stiffness of the core 114 may be varied to vary the flexibility of the cord 102. For example, the more rigid the core 114, the more rigid the pull cord 102. In some instances, the pull cord 102 may bend or deflect in response to a bending force, whereas the flexible operating cords 110 may drape around one another. Another way of interpreting the rigidity of the pull cord 102 would be to appreciate that if the pull cord 102 were supported along half its length on a horizontal surface with the other half or free half of the stiffened pull cord 102 extending beyond an edge of the horizontal surface, the free half of the stiffened pull cord 102 may not drop, deflect, or curve visually and would rather stay substantially horizontal. In other words, the stiffened pull cord 102 may have sufficient rigidity to act as cantilever beam in supporting its own weight (or a portion thereof) when extending past a support member, such as the horizontal surface. Typical operating cords, such as flexible operating cords, would drape and would not extend past the edge of the horizontal surface and thus would drop rather than staying substantially horizontal, such as the stiffened pull cord 102.

The core 114 may also allow for the pull cord 102 to substantially resist bending, especially bending due to light forces. For example, the pull cord 102 (due to the core 114) may resist easily bending into a shape that could entangle the pull cord 102 with itself, such as a loop, circle, or knot of some sort. Also, the pull cord 102 may also resist selective deformation into a self-supported final shape where it may become entangled due to an external force.

The core 114 may be resilient since it may deform at least slightly due to a force, but after the force is removed the core 114 may return to its ordinal shape. However, in some instances, the core 114 may also be subjected to plastic deformation, where after the force is removed the core 114 may have some residual or remaining deformation, but largely the core 114 may substantially return to its original shape and level of stiffness.

With reference to FIGS. 4 and 5, in some embodiments, the core 114 may be a substantially rigid material such as plastic, wood, metal or the like, whereas the sheath 116 encasing the core 114 may be a material that may or may not be rigid. It should be noted that the term rigid as used to define the pull cord 102 of the present disclosure is intended to mean for purposes of the present disclosure, a substantially rigid cord that retains its linear configuration without undue force. Such a stiffened pull cord might be defined pursuant to its modulus of elasticity. In other words, the core 114 may have a modulus of elasticity ranging between 20-30 million pounds per square inch (psi).

Additionally, in some instances, the core 114 may have a diameter ranging between 0.125 inches to 0.20 inches so that the core 114 may have a desired rigidity. A diameter of this range may permit the cord 102 to be much smaller in diameter than wands used in window coverings to tilt slats found in the covering.

In other embodiments, the pull cord 102 may have an increased flexibility and in these embodiments, the core 114 may be less rigid than in embodiments where the pull cord 102 is rigid. For example, the core 114 may be a plastic polymer composite or the like and may be flexible but somewhat rigid, i.e. rigidified relative to conventional operating cords, so that it resists becoming entangled with itself. In some embodiments, the core 114 may be a fiberglass composite, which may allow the core 114 to have some flexibility as compared to full rigid materials (e.g., metal), while still substantially preventing the cord 102 from becoming entangled. In these embodiments, the stiffened pull cord 102 may be substantially any desirable length with the diameter, cross-section, and material, and consequently its rigidity, being determined from the length necessary for operation of the covering 100. In other words, a longer cord would desirably be made of a more rigid material or have a greater diameter to prevent undue flexing of the material, while a shorter length of material might not need to be made of as rigid a material or a material of as great a diameter since it is more difficult to flex a shorter length of such material.

In embodiments where the core 114 may be rigidified, but not rigid, the core 114 material may have a modulus of elasticity in the range of 3.5 to 12 million psi so that the degree of flexibility can be determined by the length, diameter, cross-sectional configuration, and inherent characteristics of the material from which the core 114 strand or fiber is made as well as the amount of influence the sheath 116 has on the flexibility of the final cord 102. The diameter of the core 114 may be at least a minimum of 0.050 inches. This may be to ensure that the core 114 may prevent the cord 102 from forming a loop or otherwise entangling itself, despite the reduced rigidity of the core 114 material. Another way of understanding the flexibility/rigidity of the cord 102 in these embodiments may be to appreciate that if the cord 102 were supported along half its length on a horizontal surface allowing the other or free half to extend away from an edge of the surface (such as a cantilever), the free half would visually drop, deflect, or curve at an angle in a range from 1 or 2 degrees to possibly 30 degrees. Typical flexible operating cords would drape and may bend to 90 degrees or more, as they may not be sufficiently rigid to support themselves without a support surface underneath.

As mentioned previously, the rigidity or lack of flexibility for the pull cord 102 of the present disclosure may be determined from a number of factors such as the inherent rigidifying characteristics of the material from which the core 114 and/or sheath 116 is made, the length of the pull cord 102, the diameter of the pull cord 102, as well as its cross-sectional shape. Each of those factors can be taken into consideration when designing the cord 102 so that it has in its final form the desired flexibility/rigidity to avoid entanglement upon itself.

Figure 10:
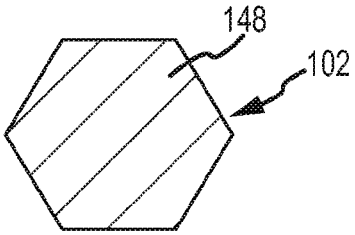
FIG. 10 is a cross-section view of a third example of a pull cord similar to FIG. 8 without a sheath.
Figure 8:
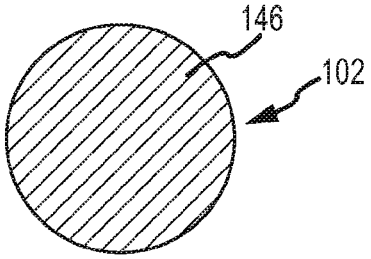
FIG. 8 is an enlarged cross-section taken along line 8-8 in FIG. 7.
Figure 11:
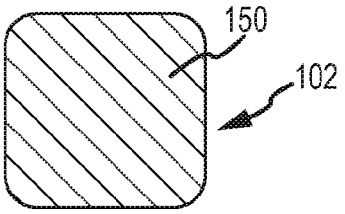
FIG. 11 is a cross-section view of a fourth example of a pull cord without an outer sheath.

The diameter or dimension of the cross-section of the core 114 for the final cord 102 may be determined to some degree with its degree of flexibility but also might be partially determined by aesthetics as broader or narrower pull cords may be desirable for particular coverings. The same is true of the cross-sectional shape of the core material with various cross-sections being illustrated, for example, in FIG. 8 where the cross-section 146 is circular, FIG. 10 where the cross-section 148 is hexagonal, and FIG. 11 where the cross-section 150 is quadrangular. Each cross-section would have a different flex capability and thus a different bearing on the overall rigidity or flexibility of the final pull cord 102.

With reference again to FIGS. 3, 4, and 5, the sheath 116 may be made of a synthetic braid, webbing, or woven material such as polyester or natural blends of another synthetic or natural fiber as the sheath 112 may provide a desired tactile finish to the stiffened pull cord 102. For example, some users may prefer the tactile feeling of a non-rigid material such as a woven or non-woven fabric or other similar material compared to the rigid material of the core 114. Thus, in these instances, the core 114 may be received into the sheet 116 to provide a desirable feeling for the user. Furthermore, in some instances, the sheath 116 may be made out of a similar material to the flexible operating cords 118 in order to provide a similar aesthetic appearance as the flexible operating cords 118.

With specific reference to FIG. 4, although the core 114 is encased within the sheath 116, the core 114 may not extend the entire length of the sheath 116. For example, the core 114 may terminate prior to a first end of the sheath 116 to define a void space 122 within the sheath 116. The void space 122 may allow the sheath 116 to knotted, and/or received within the connecting member 112 and/or tassel 106. In other examples, the void space 122 may be filed with additional sheath material, or may be omitted and the core 114 may extend the entire length of the sheath 116.

Figure 6:
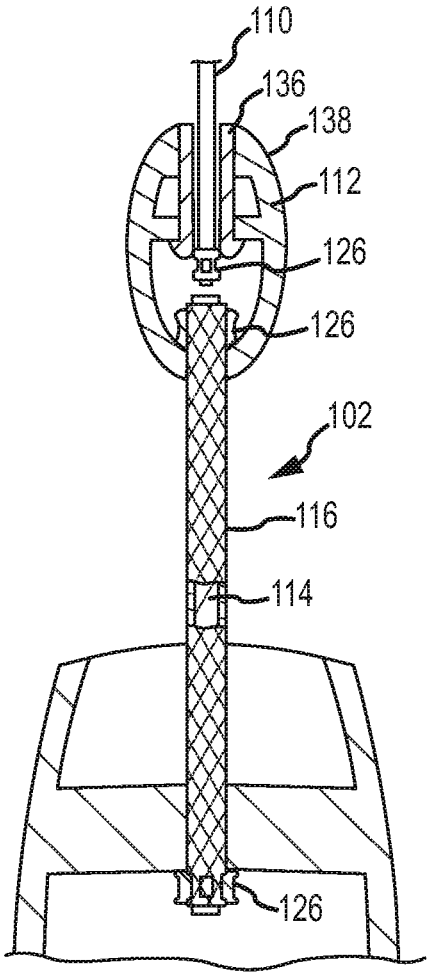
FIG. 6 is an enlarged vertical cross-section similar to FIG. 4 illustrating an alternative system for operably connecting the pull cord to the tassel and connector.

With reference to FIG. 4, the tassel 106 at the lower end of the stiffened pull cord 102 and the connecting 112 at the upper end of the stiffened pull cord 102 may be secured to the pull cord 102 in any suitable manner such as knotting the sheath 116 material within the tassel or connector as shown in FIG. 4, crimping collars 126 on the pull cord 102 as shown in FIG. 6 may be used, or the core 114 may include retaining members 140 at either end to retain the cord 102 within the receiving apertures 128, 130 as shown in FIG. 7.

In some instances, such as shown in FIG. 4, the stiffened pull cord 102 may be threaded into a receiving aperture 128 defined in the tassel 106 and a knot 120 may be formed in the sheath 116 (as the core 114 may terminate prior to the void space 122) to secure the pull cord 102 to the tassel 106. The receiving aperture 128 may be defined in an outer and/or inner wall of the tassel 106. That is, the receiving aperture 128 may be formed through one or more walls of the tassel 106 such that the sheath 116 may be attached in middle portion of the tassel 106 or may be attached along an outer wall 132 of the tassel 106.

The stiffened pull cord 102 may be operably connected to the connecting member 112 in a similar manner. The connecting member 112 may be positioned between the stiffened pull cord 102 and the flexible operating cords 110 in order to operably connect the stiffened pull cord 102 to the flexible operating cords 110. It should be noted that in other embodiments, the flexible operation cords 110 may be operably connected to the stiffened pull cord 102 in other manners, such as adhesive, fasteners, or the like. Additionally, in some embodiments, the connecting member 112 may further act as a stopper in order to prevent the stiffened pull cord 102 from being retracted into the headrail 104 and/or control system. This may allow the stiffened pull cord 102 to be accessible to a user regardless of the position of the covering 100, as well as may prevent damage to the pull cord 102 and/or control system due to the pull cord 102 being pulled therein.

The connecting member 112 may also be releasably secured to the flexible operating cords 110 and/or the stiffened pull cord 102. This may allow the stiffened pull cord 102 to be removed and replaced, without requiring the removal of the flexible operating cords 110.

The connecting member 112 may be generally oval or circular shape, although other shapes are envisioned. The connecting member 112 may include an outer wall 138 that may define a cavity 139 that may receive the flexible cords 110 and the pull cord 102. The connecting member 112 may also include a shelf 135 extending from an inner side surface of the wall 138 into the cavity 139 and a step 133 of material that may extend downwards into the cavity 139 from the top of the wall 138. Receiving apertures 130, 134 may be defined in the top and bottom ends 141, 143 of the wall 138 of the connecting member 112, respectively.

The connecting member 112 may also include a receiving member 136 that may be inserted into the top receiving aperture 134 and positioned between two ends of the shelf 135. The receiving member 136 may define a channel 145 for receiving the flexible cords 110. The receiving member 136 may be a cylindrical shaped member including a flange 137 extending form a bottom portion. The flange 137 may secure the receiving member 136 to the shelf 135. It should be noted that in other embodiments, the receiving member 136 may be omitted and the flexible cords 110 may be received directly through the receiving aperture 134.

With continued reference to FIG. 4, the pull cord 102 may be operably connected to the connecting member 112 in substantially any manner, such as by adhesive, fasteners, or the like. In some embodiments, the sheath 116 may be threaded through the receiving aperture 130 of the connecting member 112 and a knot 118 may be formed in the sheath 116 to secure the pull cord 102 to the connecting member 112. Additionally, the connecting member 112 may be operably connected to the flexible operating cords 110 on an end opposite of the pull cord 102. For example the flexible operating cords 110 may be received within the channel 145 defined within the receiving member 136 positioned within the receiving aperture 134 to provide additional strength thereto. In this example, the flexible operating cords 110 may include a knot 124 or other widening member that may be wider than the channel 141 to secure the flexible operating cords 110 to the receiving member 136. In other examples, the flexible operating cords 110 may be received directly through the top aperture 134 and/or shelf 135 of the connecting member 112. As the connecting member 112 operably connects the flexible operating cords 110 and the pull cord 102 together, a force experienced by the stiffened pull cord 112 may be transmitted to the flexible operating cords 110.

With reference to FIGS. 6 and 7, other connection mechanisms may be used to secure the stiffened pull cord 102 and/or the flexible operating cords 110 to the tassel 106 and/or the connecting member 112. For example, one or more collars 126 may be operably connected to the ends of the stiffened pull cord 102 and/or flexible operating cords 110 in order to substantially prevent the pull cord 102 and/or flexible operating cords 110 from being pulled out of the receiving apertures 128, 130, 134. In these embodiments, the core 114 may extend through the receiving apertures 128, 130 of the tassel 106 and connecting member 112, respectively. This is because the stiffened pull cord 102 may not need to be tied in a knot in order to be secured to the tassel 106 and connecting member 112. However, in other embodiments, the core 114 may still terminate prior to the end of the stiffened pull cord 102 as shown in FIG. 4.

Figure 9:
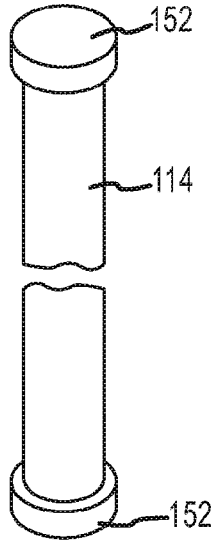
FIG. 9 is a fragmentary isometric view of a second example of a pull cord again without an outer sheath.

With reference to FIG. 7, the core 114 and/or sheath 116 (in embodiments where the sheath 116 may be included) may include retaining members 140 at either end of the pull cord 102. The retaining members 140 may have a larger diameter than the receiving apertures 128, 130 to secure the pull cord 102 to the tassel 106 and connecting member 112, respectively. The retaining members 140 may be integrally formed in the core 114, such as beads formed at the ends of the core 114. In other embodiments, the retaining members 140 may be operably connected to the core 114, such as end members that are fastened to the core 114 after the core 114 is received through the apertures 128, 130. FIG. 9 shows still another embodiment where the retaining members 140 are cylindrical disks 152 formed on opposite ends of the core 114.

With reference to FIGS. 3, 4, and 6, the stiffened pull cord 102 pursuant to the present disclosure can be made of aesthetically desirable and acceptable cross-dimensional shapes and sizes with the sheath 116 (if it is included) also providing a means for enhancing aesthetics. Accordingly, such stiffened pull cords 112 can be made to be much more slender or thinner than conventional rigid wands found in coverings for architectural openings. The rigid wands currently found in such coverings are of necessity fairly thick or broad in cross-section as they are utilized only to twist or rotate about their longitudinal axis in tilting vanes or slats of the covering between desired inclinations and must therefore resist torque applied thereto. The pull cord 102 of the present disclosure is not used to tilt slats or vanes by rotating the stiffened pull cord about its longitudinal axis, but is used to pull downwardly on the ends of the more flexible operating cords 110 found in such coverings which are connected to the stiffened pull cord 102 of the present disclosure with the connector 112.

Referring now to FIGS. 1 and 2, when the pull cord 102 is used with a unidirectional drive system of the type described previously, it will be appreciated that the stiffened pull cord can be pulled downwardly a predetermined amount commonly referred to as a down stroke and during that down stroke the shade material 108 is driven upwardly toward a retracted position or downwardly toward an extended position a distance determined by the length of the stroke. The downward angle at which the pull cord 102 is pulled may determine whether or not the shade 106 is raised or lowered. After the pull cord 102 has completed a downward stroke, the control system for the covering automatically retracts the pull cord 102 upwardly thus pulling all of the operating cords 110 back into the headrail 104 where they are substantially confined. At the top of an upward stroke, the connector 112 is generally engaged or closely adjacent to the headrail 104, as seen in FIG. 1, so that the only thing depending from the headrail 104 may be the stiffened pull cord 102 which, as mentioned previously, may not get entangled upon itself due to the fact that it is rigid along its length. Further, as long as the length of the pull cord 102 may be longer than a full downward stroke, the stiffened pull cord 102 may not become entangled with the more flexible cords 110 when they are extended from the headrail 104.

What is claimed is:

1. A covering for an architectural opening comprising in combination:

a headrail;

a shade material suspended from the headrail for movement between extended and retracted positions; and a manually operable stiffened pull cord operatively connected to the shade material and movable upwardly and downwardly to move the shade material between the extended and retracted positions, the stiffened pull cord having an at least partially rigid core and an outer sheath at least partially surrounding the core, wherein:

the core does not move relative to the sheath such that the core and the sheath move together during the upward and downward movement of the stiffened pull cord to move the shade material between the extended and retracted positions;

the core extends substantially the entire length of the stiffened pull cord; and the core is flexible but somewhat rigid so that it resists becoming entangled with itself.

2. The covering of claim 1, wherein the sheath has an increased flexibility compared to the core, and a material forming the core resists bending into a loop or circle.

3. The covering of claim 1, wherein the stiffened pull cord is operatively connected to the shade material with one or more operating cords, each of the one or more operating cords having a terminal end connected to the stiffened pull cord at an upper end of the stiffened pull cord, wherein the stiffened pull cord is movable up and down to reciprocally move the respective terminal end of the one or more operating cords toward and away from the headrail by a length defined as a stroke of the stiffened pull cord.

4. The covering of claim 3, wherein the stiffened pull cord is longer than the stroke.

5. The covering of claim 3, wherein the stiffened pull cord is more rigid than the one or more operating cords.

6. The covering of claim 3, wherein the covering further includes an operating system operatively connected to the one or more operating cords, the operating system through the one or more operating cords moving the shade material in an extending or retracting direction upon a selected downward pull on the stiffened pull cord and automatically raising the stiffened pull cord without causing movement of the shade material after the selected downward pull on the stiffened pull cord.

7. The covering of claim 3, wherein the sheath is more flexible than the core.

8. The covering of claim 3, wherein the stiffened pull cord has a modulus of elasticity between 20 and 30 million pounds per square inch.

9. The covering of claim 3, wherein the stiffened pull cord has a modulus of elasticity between 3.5 and 12 million pounds per square inch.

10. A covering for an architectural opening comprising:

a headrail;

a shade material suspended from the headrail;

an operating system for moving the shade material between an extended position and a retracted position;

a flexible operating cord operably connected to the operating system; and an at least partially rigid pull cord operably connected to the flexible operating cord, wherein:

the at least partially rigid pull cord is flexible but somewhat rigid so that it resists becoming entangled with itself;

moving the at least partially rigid pull cord upwards and downwards moves the shade material between the extended position and the retracted position;

when moving the at least partially rigid pull cord downwards a portion of the flexible operating cord is exposed; and the at least partially rigid pull cord comprises an at least partially rigid core and a sheath at least partially encasing the core, the core extending substantially the entire length of the at least partially rigid pull cord and restricted from moving relative to the sheath such that the core and the sheath move together during the upwards and downwards movement of the at least partially rigid pull cord to move the shade material between the extended and retracted positions.

11. The covering of claim 10, wherein the core has a first rigidity and the sheath has a second rigidity that is less than the first rigidity.

12. The covering of claim 11, wherein the flexible operating cord has a third rigidity that is less than the first rigidity.

13. The covering of claim 12, wherein the third rigidity of the flexible operating cord is approximately the same as the second rigidity of the sheath.

14. The covering of claim 12, further comprising a connecting member operably connected to the at least partially rigid pull cord and the flexible operating cord.

15. The covering of claim 14, wherein the at least partially rigid pull cord further comprises at least one retaining member that secures the at least partially rigid pull cord to the connecting member.

16. The covering of claim 10, wherein the core is one of wood, metal, fiberglass composite, or a plastic polymer composite and the sheath is a woven or non-woven fabric material.

17. A covering for an architectural opening comprising:

a headrail;

a shade material suspended from the headrail for movement between extended and retracted positions; and a manually operable stiffened pull cord movable upwardly and downwardly and operatively connected to the shade material to move the shade material between the extended and retracted positions, the stiffened pull cord comprising a core having a diameter in the range of 0.125 to 0.20 inches and an outer sheath at least partially surrounding the core, wherein:

the core is flexible but somewhat rigid so that it resists becoming entangled with itself;

the core does not move relative to the sheath such that the core and the sheath move together during the upward and downward movement of the stiffened pull cord to move the shade material between the extended and retracted positions; and the core extends substantially the entire length of the stiffened pull cord.

18. A covering for an architectural opening comprising:

a headrail;

a shade material suspended from the headrail for movement between extended and retracted positions; and a flexible pull cord suspended from an end of the headrail and operatively connected to the shade material for movement thereof, the pull cord comprising a core made from a material with a modulus of elasticity in the range of 3.5 to 12 million pounds per square inch and an outer sheath at least partially surrounding the core, wherein:

the core is flexible but somewhat rigid so that it resists becoming entangled with itself;

the core does not move relative to the sheath; and the core extends substantially the entire length of the pull cord.

19. The covering of claim 18, wherein the core comprises one material and the sheath comprises a different material.

20. The covering of claim 18, wherein the pull cord has a length greater than an extended pull length of an operating system.

21. The covering of claim 1, wherein the stiffened pull cord includes opposing ends, each of the opposing ends including a connection mechanism.

22. The covering of claim 21, wherein each connection mechanism is a knot, a collar, or a retaining member.

* * * * *